US010497230B2

(12) United States Patent
Lamb et al.

(10) Patent No.: US 10,497,230 B2
(45) Date of Patent: Dec. 3, 2019

(54) SMART BARRIER ALARM DEVICE

(71) Applicant: Ecolink Intelligent Technology, Inc., Carlsbad, CA (US)

(72) Inventors: Michael Lamb, Carlsbad, CA (US); Michael Bailey, Rancho Santa Fe, CA (US); Thomas Thibault, San Diego, CA (US); George Seelman, Temecula, CA (US); Carlo Q. Petrucci, San Marcos, CA (US)

(73) Assignee: Ecolink Intelligent Technology, Inc., Carlsbad, CA (US)

( * ) Notice: Subject to any disclaimer, the term of this patent is extended or adjusted under 35 U.S.C. 154(b) by 0 days.

(21) Appl. No.: 15/946,511

(22) Filed: Apr. 5, 2018

(65) Prior Publication Data

US 2018/0225937 A1 Aug. 9, 2018

Related U.S. Application Data

(62) Division of application No. 14/629,370, filed on Feb. 23, 2015, now Pat. No. 9,940,797.

(51) Int. Cl.

| | |
|---|---|
| ***G08B 21/00*** | (2006.01) |
| ***G08B 13/08*** | (2006.01) |
| ***G08B 13/16*** | (2006.01) |
| ***G08B 21/04*** | (2006.01) |
| ***G08B 25/00*** | (2006.01) |

(52) U.S. Cl.

CPC ..... *G08B 13/08* (2013.01); *G08B 13/1618* (2013.01); *G08B 21/0415* (2013.01); *G08B 21/0469* (2013.01); *G08B 25/008* (2013.01)

(58) Field of Classification Search

CPC ..... G08B 25/008; G08B 13/08; G08B 13/02; G08B 13/1618; G08B 21/0415; G08B 21/0469; G08B 29/04; G08B 29/12; G08B 13/2491; G08B 21/22; G08B 29/20; E05F 15/668; E05F 15/77; E05F 15/00; E05F 15/76; E05Y 2900/106; E05Y 2900/538; E05Y 2400/822; E05Y 2400/44;

(Continued)

(56) References Cited

U.S. PATENT DOCUMENTS 4,639,902 A 1/1987 Leverance et al.
5,534,849 A 7/1996 McDonald et al.

(Continued)

FOREIGN PATENT DOCUMENTS

WO 2007111802 A2 10/2007

OTHER PUBLICATIONS

ISA/US, Int. Search Report and Written Opinion issued on PCT/US16/17807, dated May 6, 2016, 13 pages.

*Primary Examiner* — Daniel Previl

(74) *Attorney, Agent, or Firm* — Greenberg Traurig, LLP

(57) ABSTRACT

A barrier alarm device for reducing the number of false alarms that may occur in a home security system. In one embodiment, a barrier alarm device, such as a door or window sensor, determines whether a barrier, such as a door or a window, has been opened, determines whether a human being is in proximity to the door or window inside a monitored premises. If a human being is inside the monitored premises when the door or window is opened, it indicates that the human being is authorized to be inside the monitored premises, and an alarm signal is not transmitted to a central security panel, thus reducing false alarms.

20 Claims, 6 Drawing Sheets

(58) Field of Classification Search
CPC ..... E05Y 2400/456; E05Y 2400/664; E05Y 2800/00; E05Y 2400/334; E05Y 2400/506; E05Y 2400/514; E05Y 2400/814; G07C 2009/00261; G07C 2009/00793; G07C 2009/00928; G07C 9/00182; E05D 13/1269; G01B 7/14; G01R 33/0023; G01R 33/02
USPC ..... 340/501, 573.1, 551, 825.36, 5.1, 10.4, 340/573.2, 573.3, 573.4, 552–554, 572.2, 340/572.4, 572, 6
See application file for complete search history.

(56) References Cited

U.S. PATENT DOCUMENTS 5,656,900 A 8/1997 Michel et al.
6,392,547 B1 * 5/2002 Stewart ..... G08B 13/1427 340/539.23
6,919,918 B2 7/2005 Carretero Guerrero
9,245,439 B2 * 1/2016 Lamb ..... G08B 13/02
2001/0056579 A1 12/2001 Kogane et al.
2004/0021778 A1 2/2004 Oldani et al.
2006/0170572 A1 8/2006 Kurachi et al.
2007/0089467 A1 * 4/2007 Ace-Kirker ..... A47G 29/10 70/63
2007/0132578 A1 6/2007 Powell
2007/0182540 A1 * 8/2007 Marman ..... G06K 9/00362 340/506
2008/0157964 A1 * 7/2008 Eskildsen ..... G08B 29/188 340/545.1
2010/0245088 A1 9/2010 Meier et al.
2013/0249730 A1 * 9/2013 Adcook ..... G01S 13/87 342/22
2013/0257611 A1 * 10/2013 Lamb ..... G08B 13/02 340/501
2015/0097669 A1 4/2015 Li

* cited by examiner

SMART BARRIER ALARM DEVICE

CROSS-REFERENCE TO RELATED APPLICATION

The present application is a divisional of U.S. patent application Ser. No. 14/629,370, filed on Feb. 3, 2015.

BACKGROUND

Field of Use

The present application relates to the field of home security. More specifically, the present application relates to a barrier alarm device that helps reduce the occurrences of false alarms.

Description of the Related Art

Security systems for homes and businesses have been around for many years. Often, these systems make use of barrier alarm devices, such as door and window sensors, motion detectors, sound detectors, etc. Door and window alarms typically comprise two distinct parts: a magnet and a reed switch/transmitter assembly. The reed switch/transmitter assembly is typically installed onto a stationary surface, such as a door or window frame, while the magnet is mounted to a movable portion of a door or window. When the door or window is closed, the magnet and reed switch are in close proximity to one another, maintaining the reed switch in a first state indicative of a "no alarm" condition. If the door or window is opened, proximity is lost between the magnet and the reed switch, resulting in the reed switch changing state, e.g., from closed to open or from open to closed. The change of state is indicative of a local alarm condition, and a signal may be generated by circuitry located within the reed switch assembly and sent, via wires or over-the-air, to a central security panel or gateway in the home, which may forward the signal to a remote monitoring station. In addition, a loud audible alert is typically generated, either at the central security panel in the home or directly by the circuitry within the reed switch assembly, indicating that a door or window has been opened.

One problem with security systems is the relatively frequent occurrence of false alarms. Most security systems offer a "home" arming feature which arms all door and window sensors, but does not arm any interior motion sensors. In this way, occupants are protected against intruders while being able to move about within the home without causing motion sensors to alarm. Often times, occupants forget that the security system is armed, and when they open a door or a window, a false alarm is triggered. These false alarms sometimes cause a response by police or fire personnel, wasting valuable public resources. Additionally, homeowners may be fined if too many false alarms occur within a certain time period.

It would be desirable to provide a security system that allows occupants to open doors or windows while the security system is in an armed, "home" mode of operation, without triggering an alarm.

SUMMARY

The embodiments described herein relate to methods, systems, and apparatus for monitoring a barrier by a barrier alarm device that reduces or prevents false alarms from occurring. In one embodiment, a barrier alarm device comprises a barrier status detection device for detecting whether a barrier monitored by the barrier alarm device has been opened, a human detection device for determining whether a human being is inside a monitored premises in proximity to the barrier, a transmitter for transmitting an alarm signal to a central security panel, a memory having processor-executable instructions stored thereon, and a processor coupled to the barrier status detection device, the human detection device, the transmitter, and the memory for executing the processor-executable instructions that cause the barrier alarm device to generate the alarm signal when the processor determines that the barrier has been opened based on the barrier status detection device and that a human being is not in proximity to the barrier human detection device.

In another embodiment, a system is described for monitoring a barrier of a premises, comprising a barrier alarm device installed proximate to the barrier, comprising a barrier status detection device for detecting whether the barrier monitored by the barrier alarm device has been opened, a human detection device for determining whether a human being is inside the premises in proximity to the monitored barrier or not, a transmitter for transmitting status signals to a receiver, a memory having processor-executable instructions stored thereon, and a processor coupled to the barrier status detection device, the human detection device, the transmitter, and the memory for executing the processor-executable instructions that cause the barrier alarm device to: determine a barrier status as being open or closed using signals provided by the barrier status detection device, determine a human being status as being inside the premises in proximity to the monitored barrier or not using signals from the human detection device, transmit a barrier status signal to the receiver, and transmit a human status signal to the receiver. The receiver receives the barrier status signal and the human status signal and for generating an alarm signal if the receiver determines that the barrier has been opened from the barrier status signal, and a human being is not in proximity to the barrier from the human status signal.

In yet another embodiment, a method is described for a barrier alarm device to reduce occurrences of false alarms, comprising determining, by a processor coupled to a barrier status detection device, whether a barrier monitored by the barrier alarm device has been opened, determining, by the processor coupled to a human detection device, whether a human being is inside a monitored premises in proximity to the barrier, and generating, by the processor, an alarm signal when the processor determines that the barrier has been opened based on the barrier status detection device and that a human being is not in proximity to the barrier human detection device.

In yet still another embodiment, a system for monitoring a barrier of a premises is described, comprising a barrier alarm device installed proximate to the barrier, the barrier alarm device comprising a barrier status detection device for detecting whether the barrier monitored by the barrier alarm device has been opened, a human detection device for determining whether a human being is inside the premises in proximity to the monitored barrier or not, a transmitter for transmitting status signals to a receiver, a memory having processor-executable instructions stored thereon, and a processor coupled to the barrier status detection device, the human detection device, the transmitter, and the memory for executing the processor-executable instructions that cause the barrier alarm device to: determine a barrier status as being open or closed using signals provided by the barrier status detection device, determine a human being status as being inside the premises in proximity to the monitored barrier or not using signals from the human detection device, transmit a barrier status signal to the receiver, and transmit a human status signal to the receiver. The receiver receives the barrier status signal and the human status signal and for forwarding the barrier status signal and the human status signal to a remote server, the remote server for generating an alarm signal if the remote server determines that the barrier has been opened from the barrier status signal, and a human being is not in proximity to the barrier from the human status signal.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The present application relates to barrier alarm devices, such as door or window sensors, that have a capability of reducing occurrences of false alarms. For the purpose of the discussions herein, the term "barrier alarm device" means any device used to monitor and report states, physical conditions, attributes, status, or parameters of an entrance/exit barrier such as a door, a window, a gate, etc. Examples of barrier alarm devices comprise door and window sensors, glass breakage detectors, light interruption detectors, etc.

Embodiments of a barrier alarm device described herein comprise a human detection device that detects the presence of a human being in proximity to the barrier alarm device, either inside or outside of monitored premises. If a person inside a home opens a monitored door or window while a security system is armed, an alarm will not be triggered if the barrier alarm device senses the person in proximity to the barrier that was opened. This new barrier alarm device operates on the principle that if a door or window is opened and a person is detected nearby the barrier alarm device on the inside of the premises, it is assumed that the person is authorized to be inside the premises, and an alarm signal should not be generated when the door or window is opened. Conversely, a new barrier alarm device may operate on the principle that if a door or window is opened, and a person is detected in proximity to the barrier alarm device on the outside of the premises, an alarm signal should be generated. Each of these principles is discussed in detail below.

Figure 1:
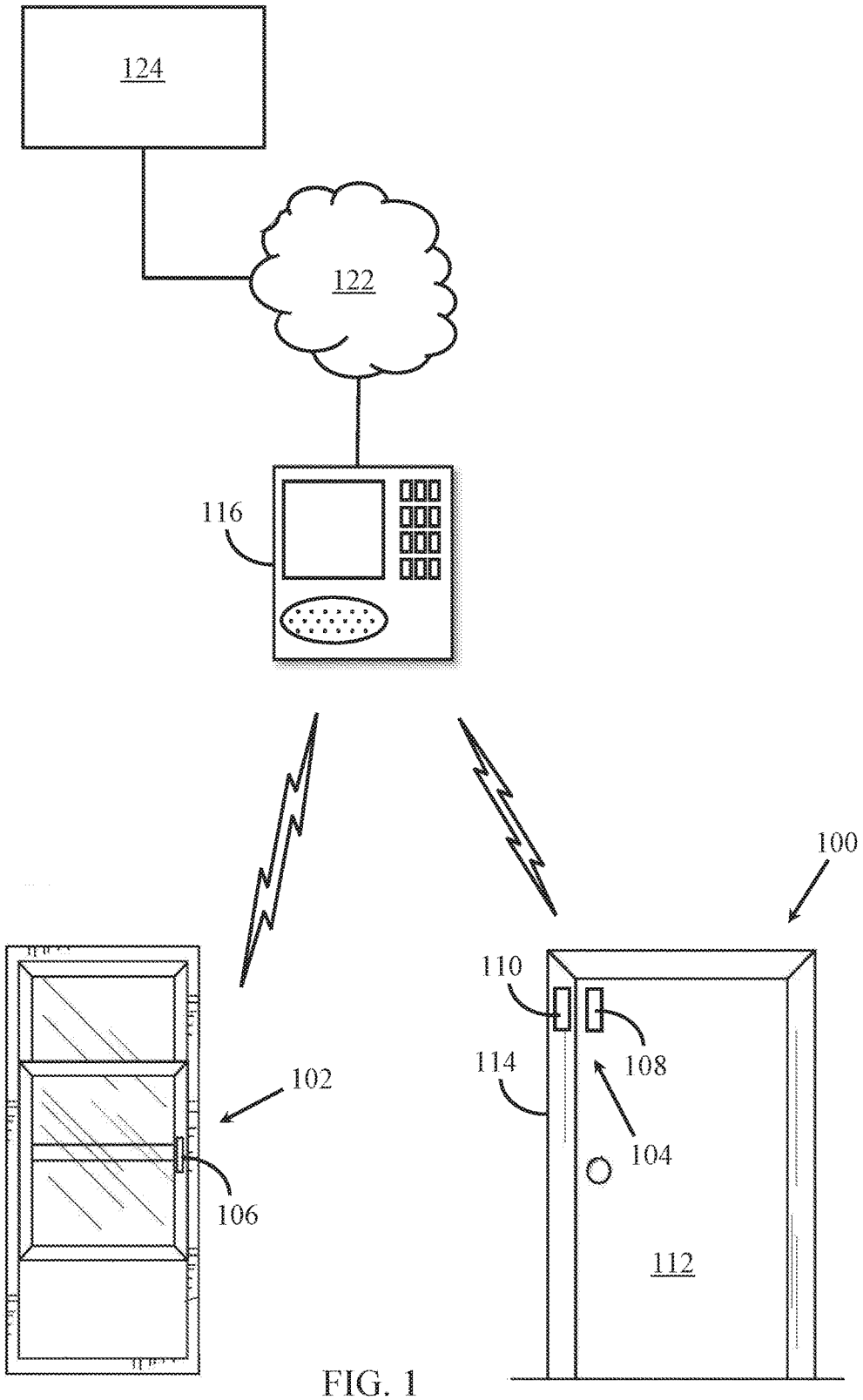
FIG. 1 is an illustration of a security system in accordance with one embodiment of the principles discussed herein.

FIG. 1 is an illustration of a security system in accordance with one embodiment of the principles discussed herein. In this embodiment a door assembly 100 and a window assembly 102 are monitored by barrier alarm devices 104 and 106, respectively. In one embodiment, barrier alarm device 104 comprises magnet 108 mounted to door 112 and reed switch assembly 110 mounted to door frame 114, while barrier alarm device 106 comprises a magnet-less type sensor. The barrier alarm devices could, use alternative techniques to magnetic field sensing to determine that status of a door or a window.

Each of the barrier alarm devices communicates with receiver, such as central security panel 116, typically using wireless RF signals generated by the barrier alarm devices and/or central security panel 116. For example, if door 112 is opened, reed switch assembly 110 detects a reduction or elimination of a magnetic field produced by magnet 108 as magnet 108 moves away from reed switch assembly 110 as door 112 is opened. In response, reed switch assembly 110 transmits a message to central security panel 116 indicative of a local alarm condition, e.g., door 112 has been opened.

Some barrier alarm devices are capable of being placed into an open position while remaining "armed". For example, some reed switch barrier alarm devices may use two magnets, a first magnet positioned near the bottom of a window and one placed several inches above the first magnet along a window frame such that the resultant opening allows air through the window but not a human being. Thus, in an open but monitored position, the window is opened so that the reed switch assembly is in close proximity to the second magnet. Then, if an unauthorized person tries to enter the premises by opening the window further, an alarm signal will be generated.

In some embodiments, central security panel 116 may send messages to either of the barrier alarm devices requesting a status of either alarm, e.g., either "open" or "closed". In response, one or both barrier alarm devices may transmit a response to central security panel 116 indicating a status of the door or window, as the case may be. Other commands may be transmitted by central security panel 116, such as "sound alarm", "turn on lights", open gate, lock doors, etc.

As described above, central security panel 116 monitors barrier alarm devices 104, 106, and other security devices (for example, a tilt sensor, shock sensor, motion detector, passive infra-red detector, light interruption detector, etc.) that may be part of the security system. Such security panels are widely used in home security systems, sold by large companies such as Honeywell Security of Melville, N.Y., 2Gig Technologies of Lehi, Utah. In addition, central security panel 116 generally provides status information to users via a display, generally providing a visual indication of the status ("open", "closed", "on", "off", "normal", "alarm", etc.) of each barrier alarm device, other security devices in the system, or the system as a whole. Central security panel 116 may also be in communication with an off-site remote monitoring station 124 via communication network 122, such as the Internet, PSTN, a fiber optic communication network, a wireless communication network (e.g., cellular, data, satellite, etc.), and/or other wide-area network. Remote monitoring station 124 typically provides security monitoring services for homes and businesses equipped with security systems such as the one shown in FIG. 1. Remote monitoring station 124 is adapted to receive communications from central security panel 116 via network 122 in response to central security panel 116 receiving an indication of an alarm condition being sensed by one or more barrier alarm devices/sensors in the security system. In other embodiments, central security panel 116 simply receives raw data from the barrier alarm devices and determines, based on the data, whether a local alarm condition has occurred. When a local alarm condition is detected, central security panel 116 generates a system alarm which may comprise taking one or more actions, such as notifying remote monitoring station 124 that a local alarm condition has occurred, illuminating one or more lights, sounding one or more audible alerts, etc.

Figure 2:
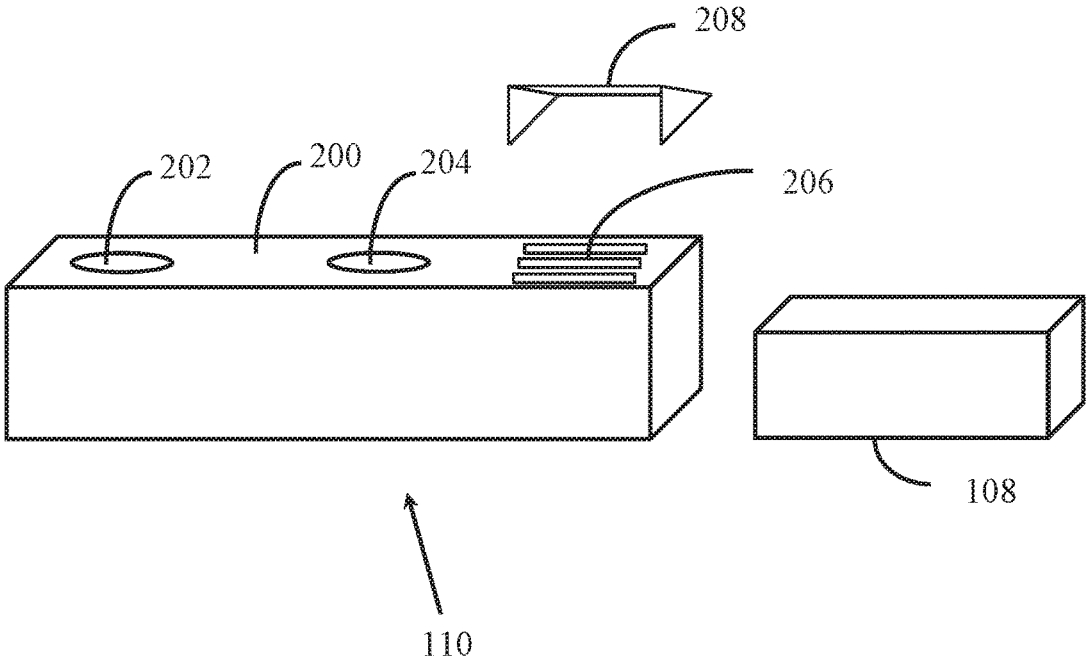
FIG. 2 is a perspective view of one embodiment of a barrier alarm device shown in FIG. 1.

FIG. 2 is a perspective view of one embodiment of a barrier alarm device, comprising magnet 108 and reed switch assembly 110. In other embodiments, the barrier alarm device may use alternative door/window status detection devices, such as an ultrasonic transducer/receiver, an infrared transmitter/receiver, or some other device to determine whether a window is open or closed. The barrier alarm device may have additional features, such as a user interface 202 and status indication 204. The user interface 202 may comprise a pushbutton or other switch to provide input to the barrier alarm device. For example, in some embodiments, user interface 202 is used to place the barrier alarm device into a "learn" state of operation for initial installation and pairing with central security panel 116. Status indicator can comprise, for example, an LED to indicate when the barrier alarm device is operating or not.

Reed switch assembly 110 comprises housing 200 that covers a processor, a barrier state detection device (in this example, a reed switch), an RF transmitter, a human detection device, and a battery. For purposes of discussion herein, the term "barrier alarm device" is used interchangeably with the term "reed switch assembly" or the combination of reed switch assembly 110 and magnet 108. Of course, the barrier alarm device could comprise any number of alternative embodiments, such as a magnet-less door window sensor, an RF detector, an RFID sensor, a light interruption detector, or any other device that is able to determine the status of a barrier such as a door or a window (i.e., whether a door or window is open or closed). The reed switch is used to detect the presence or absence of a magnetic field produced by magnet 108 and the transmitter used to transmit information to central security panel 116 relating to the status of a door or window. Reed switch assembly 110 further comprises a human detection device for detecting the presence of a person in proximity to the barrier alarm device. The term "in proximity" generally means within a distance from a barrier for a human being to open or close the barrier.

As mentioned above, reed switch assembly 110 comprises a human detection device. The human detection device detects the presence of a human being in proximity to a barrier that is being monitored by the reed switch assembly. In one embodiment, the reed switch assembly is configured to detect human beings inside a monitored premises and in proximity to a barrier and in another, configured to detect human beings outside a monitored premises and in proximity to a barrier. When configured to detect human beings outside of a monitored premises, the reed switch assembly may use a detector that is external to housing 200 and coupled to the detector via a wire or via wireless communications. For example, an ultrasonic transducer and receiver could be mounted external to a window, and a wire connecting it to the reed switch assembly.

Reed switch assembly may comprise one or more apertures 206 to allow a human detection device inside housing 200 to propagate signals in order to detect a human being in proximity to a barrier. For example, if the human detection device is an ultrasonic transducer and receiver, the apertures 206 allow ultrasonic pings to escape the housing and to be returned to the ultrasonic receiver for processing. In other embodiments, the apertures 206 may, additionally or alternatively, be located on a different surface of housing 200 in order to better direct signals used to determine the presence of a human being. For example, in the embodiment shown in FIG. 2, apertures 206 are located on "front-facing" side of housing 200. This configuration might be best for a barrier alarm device that is mounted between three and a half to six feet from the floor, for example, such as on a "head" of a movable portion of a double hung window, to project signals horizontally towards anyone who might be in proximity to the window. In an embodiment where the barrier alarm device is mounted between seven and ten feet, for example mounted to a top portion of a door, apertures 206 might be formed on the "bottom-facing" surface of housing 200, in order to project signals downwards, towards a human being who may be opening the door.

In some embodiments, a deflection device 208 may be used to better guide signals emanating from housing 200 to detect a human being after being installed over apertures 206. In one embodiment, deflection device 208 comprises a fixed structure that mounts over apertures 206. In another embodiment, deflection device 208 comprise movable "shutters" or "louvers" mounted over or through apertures 206 to allow a user to adjust the direction of signals emanating from housing 200. The deflection device 208 may be configured to guide signals at a certain angle away from the housing 200 to have the best opportunity to sense a human being, e.g., to guide signals to where a human being would expect to be when the reed switch assembly is mounted in a typical location, such as on top of a door or window frame. For example, the angle of deflection device 208 may be 45 degrees, thereby guiding signals downwards and away from the barrier by 1-2 feet or so, depending on how high the reed switch assembly is mounted.

In one embodiment, when a person is detected near barrier alarm device 110 inside a monitored premises, no alarm signal is transmitted to security panel 116 if a door or window is opened or, conversely, if a person is not detected when a door or window is opened, an alarm signal is transmitted to security panel 116. This reduces the occurrence of false alarms, because a person opening a door or window from within a monitored premise is assumed to have authorization to be there. In another embodiment, the human detection device is configured to detect the presence of a person near the barrier alarm device, but outside the monitored premises. An alarm signal will only be generated when a door or window is opened and a person is detected near the barrier alarm device, outside the monitored premises or, conversely, when a door or window is opened and no person is detected outside the door or window, no alarm signal is transmitted to central security panel 116. In another embodiment, a bypass signal is sent to central security panel 116 when it is determined that an authorized person has opened a door or a window, the bypass signal is an instruction to central the remote location 116 to ignore future alarm signals generated by the barrier alarm device or to disarm the system.

Figure 3:
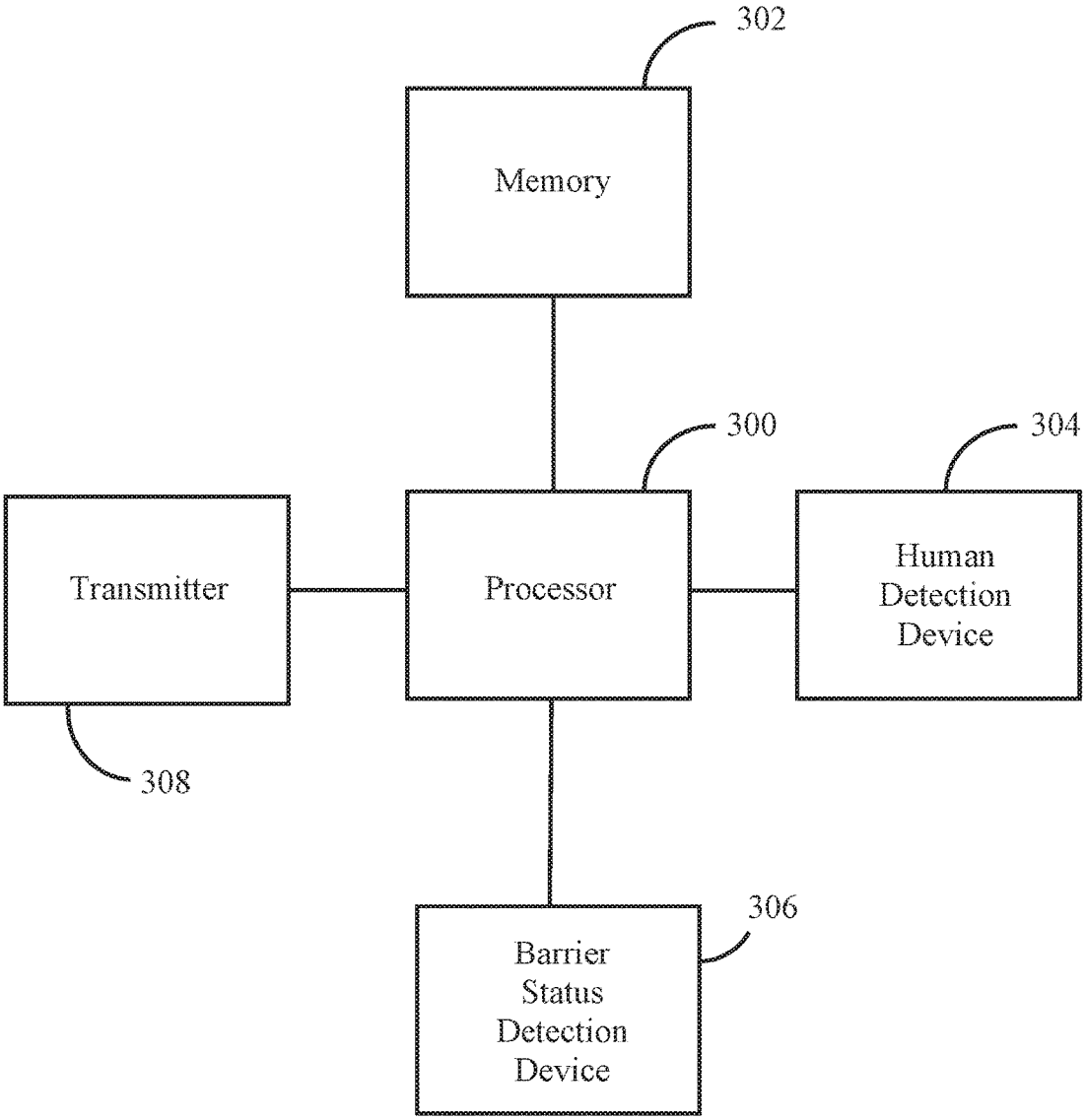
FIG. 3 is a functional block diagram of one embodiment of the barrier alarm device shown in FIG. 2.

FIG. 3 is a functional block diagram of one embodiment of a portion of barrier alarm device 104 or 106 in accordance with the teachings herein. Specifically, FIG. 3 shows processor 300, memory 302, human detection device 304, a barrier status detection device 306, and transmitter 308. It should be understood that the functional blocks may be coupled to one another in a variety of ways, and that not all functional blocks necessary for operation of the barrier alarm device are shown (such as a power supply), for purposes of clarity.

Processor 300 is configured to provide general operation of the barrier alarm device by executing processor-executable instructions stored in memory 302, for example, executable code. Processor 300 typically comprises a general purpose processor, such as an ADuC7024 analog microcontroller manufactured by Analog Devices, Inc. of Norwood Massachusetts, although any one of a variety of microprocessors, microcomputers, and/or microcontrollers may be used alternatively. Due to the relative small size of barrier alarm devices, and the fact that most barrier alarm devices are battery-powered, processor 300 is typically selected to have low power consumption, small in size, and inexpensive to purchase.

Memory 302 comprises one or more information storage devices, such as RAM memory, ROM memory, EEPROM memory, UVPROM memory, flash memory, SD memory, XD memory, or other type of electronic, optical, or mechanical memory device. Memory 302 is used to store processor-executable instructions for operation of the barrier alarm device as well as any information used by processor 300, such as threshold information, parameter information, identification information, current or previous door or window status information, etc.

Barrier status detection device 306 is coupled to processor 300 and monitors or determines a state, physical condition, attribute, status, or parameter of something, such as the status (e.g., "open", "closed", "movement detected", etc.) of a door, window, gate, or other entrance or exit barrier. Barrier status detection device 306 may comprise a reed switch, ultrasonic transducer/receiver, an infrared transmitter/receiver, an RFID receiver, a tilt sensor, an accelerometer, a gyroscope, a motion sensor, or some other device to determine whether a window is open or closed.

Human detection device 304 comprises a device or circuitry to detect the presence of a person in proximity to the barrier alarm device, either inside a monitored premises, outside a monitored premises, or both. Examples of human detection device 304 include an ultrasonic transducer/receiver, an infrared transmitter/receiver, a capacitance sensor, an RF tank circuit, an RFID receiver and RFID chip, a motion detector, or some other circuitry or device able to detect the presence of a human being proximate to the barrier alarm device, door, or window. The term "proximate to the barrier alarm device, door or window" means that a person is within a distance from a barrier alarm device, door, or window that the person could open the door or window where a barrier alarm device is installed.

In one embodiment, when a person approaches a door or window monitored by the barrier alarm device, either inside premises being monitored or outside, human detection device 304 sends a signal to processor 300 when the person is within a predetermined distance from the barrier alarm device and, thus, the monitored door or window. In another embodiment, human detection device 304 is inactive until barrier status detection device 306 determines that a monitored door or window has been opened. In this embodiment, barrier status detection device 306 sends a signal to processor 300, and processor 300 then activates the human detection device 304 to determine if a person is proximate to the barrier alarm device and, thus, the monitored door or window, either inside the monitored premises, outside, or both.

Transmitter 308 comprises circuitry necessary to wirelessly transmit alarm signals and/or status messages and/or other information from the barrier alarm device to one or more receivers, such as central security panel 116 or a gateway device coupled to a wide area network such as the Internet, either directly or through in intermediate device, such as a repeater, commonly used in popular mesh networks. Such circuitry is well known in the art and may comprise BlueTooth, Wi-Fi, RF, optical, ultrasonic circuitry, among others. Alternatively, or in addition, transmitter 308 comprises well-known circuitry to provide signals to central security panel 116 or a gateway via wiring, such as telephone wiring, twisted pair, two-conductor pair, CAT wiring, AC home wiring, or other type of wiring.

In normal operation, processor 300 executes processor-executable instructions stored in memory 302 that causes processor 300 to monitor signals provided by barrier status detection device 306 indicative of changes in one or more states, physical conditions, attributes, status, or parameters of something being monitored, such as the condition of a door or window being "open" or "closed", changes between these states, or simply "movement". Processor 300 uses this data from barrier status detection device 306 to determine whether a predetermined condition has occurred relating to the barrier alarm device (herein "local alarm condition"), such as a door or window being monitored by the barrier alarm device changing state from "closed" to "open", movement between these states, or simply "movement". Human detection device 304 monitors for the presence of a person proximate to the barrier alarm device, door or window and provides signals to processor 300 indicative of whether a human being is proximate or not. If processor 300 determines that a door or window has been opened, it checks to see whether human detection device 304 has sensed a person proximate to the barrier alarm device, door, or window. In an embodiment where human detection device 304 is configured to detect persons inside a monitored premises, processor 300 generates an alarm signal only if there is no person proximate to the barrier alarm device, door, or window inside the monitored premises, indicating that door or window movement was the result of someone outside the monitored premises attempting unauthorized entry to the premises. In an embodiment where human detection device 304 is configured to detect persons outside a monitored premises, processor 300 generates an alarm signal only if there is a person proximate to the barrier alarm device, door, or window outside the monitored premises, again indicating that door or window movement was the result of someone outside the monitored premises attempting unauthorized entry to the premises. In any case, if processor 300 determines that a local alarm condition has occurred, an alarm signal is provided to transmitter 308 for transmission to a remote location, such as central security panel 116 or a gateway. In one embodiment, the alarm signal comprises a notification to central security panel 116 that a local alarm condition has been detected at a particular door or window being monitored by the barrier alarm device.

Thus, using the barrier alarm device described above, when a person inside a monitored premises opens a door or window while a security system is armed, an alarm signal will not be generated, or it will be ignored by central security panel 116, thereby avoiding a false alarm.

Figure 4:
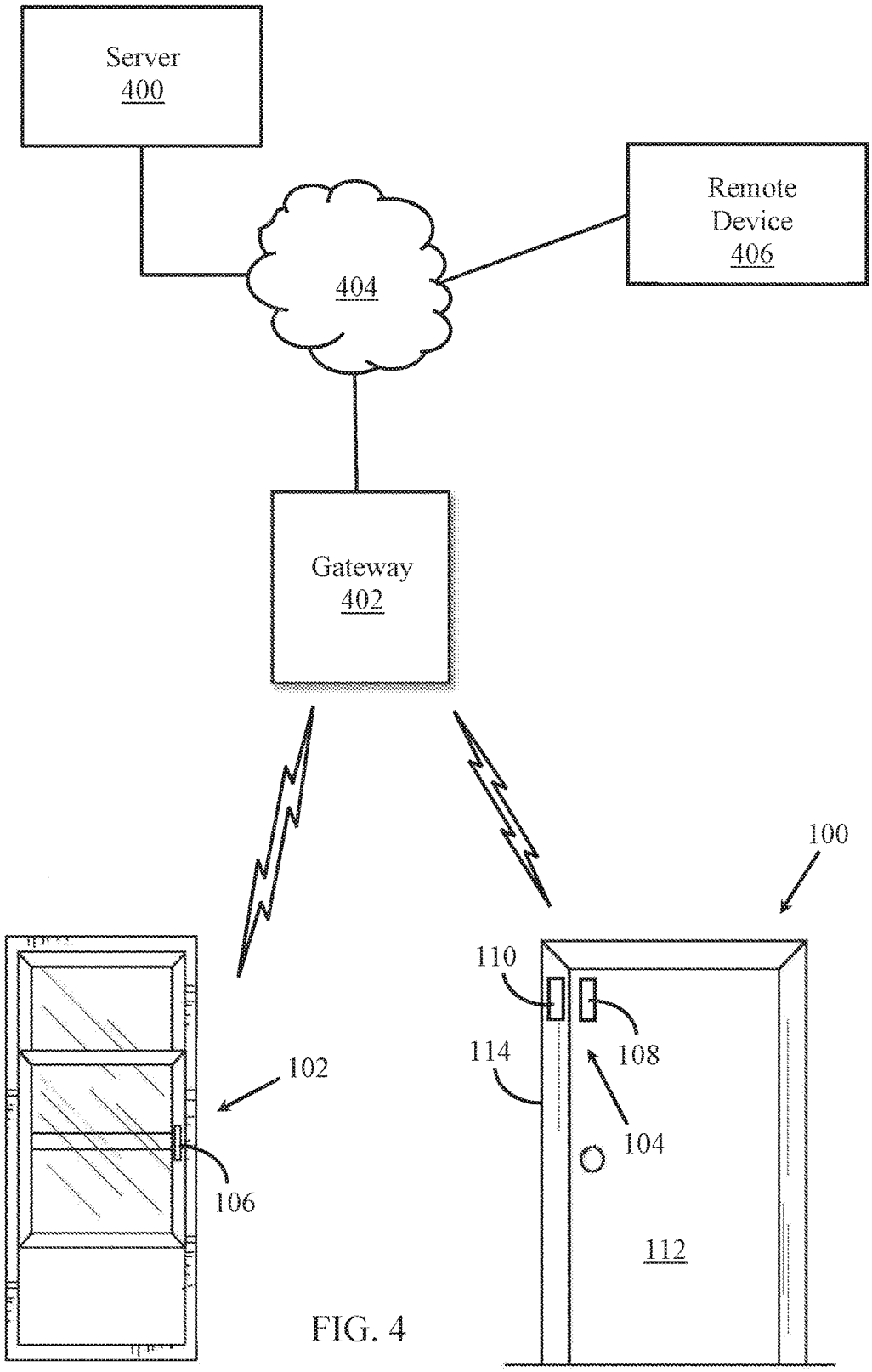
FIG. 4 is an illustration of another security system in accordance with another embodiment of the principles discussed herein.

FIG. 4 is an illustration of another security system in accordance with another embodiment of the principles discussed herein. In this embodiment, barrier alarm devices 104 and 106 communicate with a receiver such as gateway 402, which forwards communications from the barrier alarm devices to remote server 400 via wide area network 404. In one embodiment, the barrier alarm devices additionally may communicate with a second receiver, such as central alarm panel 116, as discussed previously. Gateway 402 comprises a wireless and/or wired router and/or modem commonly found in millions of homes and businesses for routing Internet traffic. In this embodiment, gateway 402 provides signals from the barrier alarm devices to remote server 400 and, in some embodiments, from remote server 400 to barrier alarm device 106. Remote server 400 comprises an electronic computing device such as a desktop or laptop computer, server, smartphone, wearable device, etc. In one embodiment, remote server 400 may communicate with one or more remote entities, such as other desktop or laptop computers, tablets, smart devices such as smartphones, wearable devices, etc., to notify interested parties of activities occurring on/in the premises being monitored by one or more barrier alarm devices. Such interested parties may include family members and friends of an owner or renter of the premises, police, fire, paramedics, a remote security monitoring center, etc.

In one embodiment, when a barrier alarm device detects that a barrier, such as a door or a window, has been opened, and further that a human being is inside the premises being monitored in proximity to the barrier, the barrier alarm device does not send an alarm signal to gateway 402, as this situation indicates that an authorized person inside the monitored premises has opened the barrier. In another embodiment, a bypass signal is transmitted to central security panel 116, as described above. Additionally, or alternatively, the barrier alarm device sends a status signal to gateway 402 to notify server 400 that a barrier has been opened. Server 400 may simply store an indication of the opening and the time that it occurred in an account associated with an account owner, i.e., the owner or renter of the monitored premises. Alternatively, or in addition, server 400 may transmit an alert to one or more remote devices 406, alerting interested parties of the opening.

When the barrier alarm device detects that a barrier has been opened, and further that a human being is not inside the premises being monitored in proximity to the barrier, the barrier alarm device sends an alarm signal to gateway 402, as this situation indicates that an unauthorized person outside the monitored premises has opened the barrier. Server 400 receives the alarm signal and typically stores the date and time of the alarm signal occurrence in an account, as described above. Alternatively, or in addition, server 400 sends a remote alarm signal to one or more remote devices 406, alerting users of those devices that a barrier has been opened by an unauthorized person. The alarm signal may also be transmitted from the barrier alarm device to central security panel 116.

In an alternative embodiment, a barrier alarm device may be configured to detect whether a human being is outside of the monitored premises in proximity to a barrier being monitored. Thus, when a barrier alarm device detects that a barrier has been opened and that a human being is outside the monitored premises in proximity to the barrier, an alarm signal is transmitted. Conversely, when a barrier alarm device 106 detects that a barrier has been opened, and that a human being is not outside the monitored premises in proximity to the barrier, an alarm signal is not transmitted (and/or a bypass signal is transmitted), as this condition indicates that an authorized person has opened the barrier. The bypass signal, or another, separate signal, may be transmitted to gateway 402, which then provides it to remote server 400 as an indication that a barrier has been opened by an authorized person.

In another embodiment, barrier alarm device 106 does not make determinations as to when to transmit an alarm signal and/or a bypass signal. Instead, processor 300 monitors barrier status determination device 306 and human detection device 304 and transmits a barrier status signal and a human status signal, respectively, to gateway 402, central security panel 116, or both, when a change in state of one or both devices occurs. Remote server 400 and/or central security panel 116 receives these status signals and determines whether a local alarm condition exists and whether to transmit an alarm signal to one or more remote devices 406 of interested parties and/or to a remote monitoring station 124. For example, as an authorized person approaches a barrier, human detection device 304 changes state and processor 300 causes transmitter 308 to transmit a human status signal to gateway 402, central security panel 116, or both, which forwards it on to remote server 400 via wide area network 404 in the case of gateway 402. If the authorized person does not open the barrier, and then walks away, barrier alarm device 106 transmits a second human status signal to gateway 402, central security panel 116, or both, indicative of the person leaving proximity to the barrier. If, however, the authorized person instead opens the barrier, barrier alarm device 106 transmits a barrier status signal to gateway 402, central security panel 116, or both, indicative of the barrier being opened. If remote server 400 and/or central security panel 116 receives this status indication signal, and the last known state of human detection device 304 is "person detected inside in proximity to barrier", then remote server 400 and/or central security panel 116 does not generate an alarm signal (but may provide a notification to interested parties of the status of the barrier such as "barrier open/authorized person present"). If no authorized person was present when the human status signal was received indicating that the barrier had been opened, remote server 400 and/or central security panel 116 generates an alarm signal that may provided to one or more interested parties and/or to remote monitoring station 124.

Figure 5:
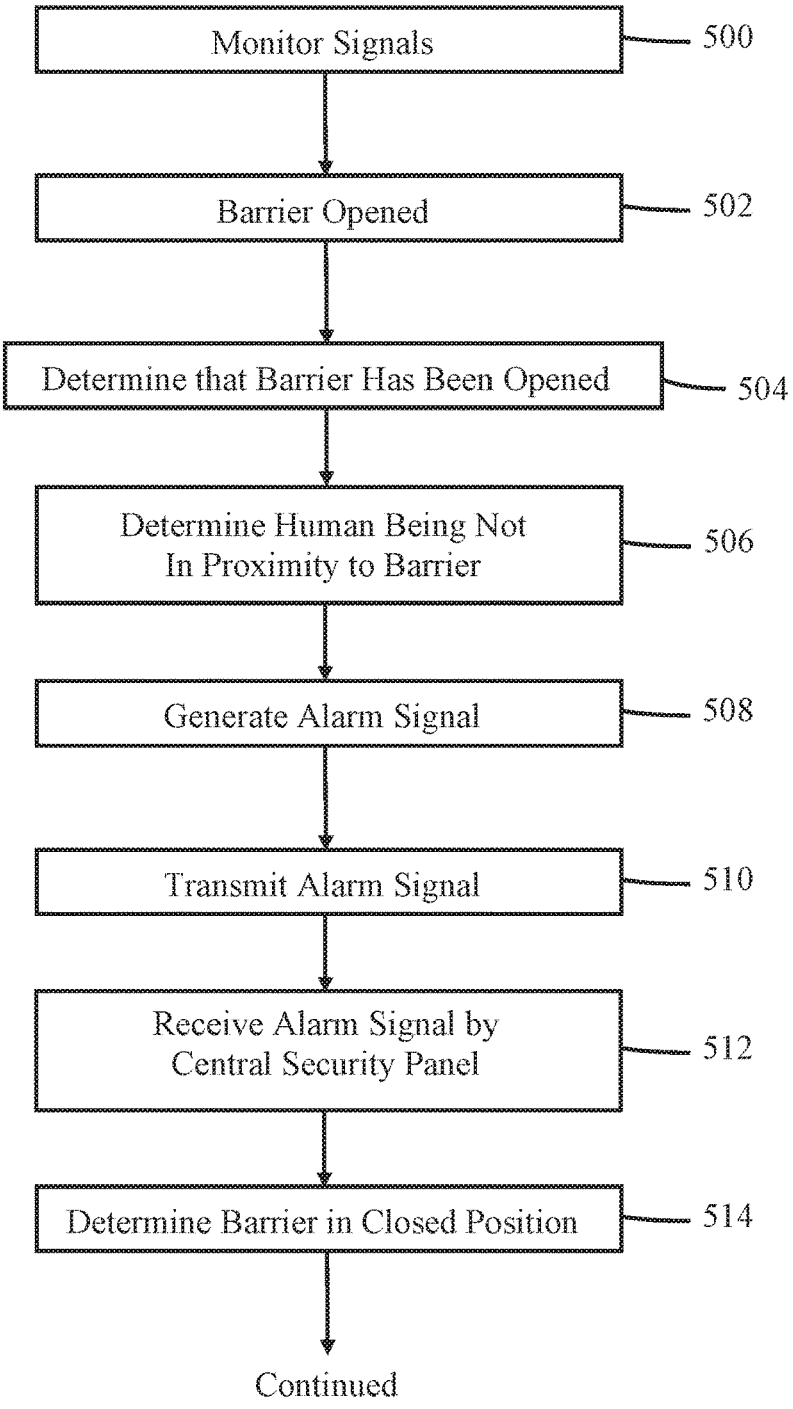
FIG. 5 is a flow diagram illustrating one embodiment of a method performed by the barrier alarm device shown in FIG. 2 when installed into a system such as FIG. 1.
Figure 5:
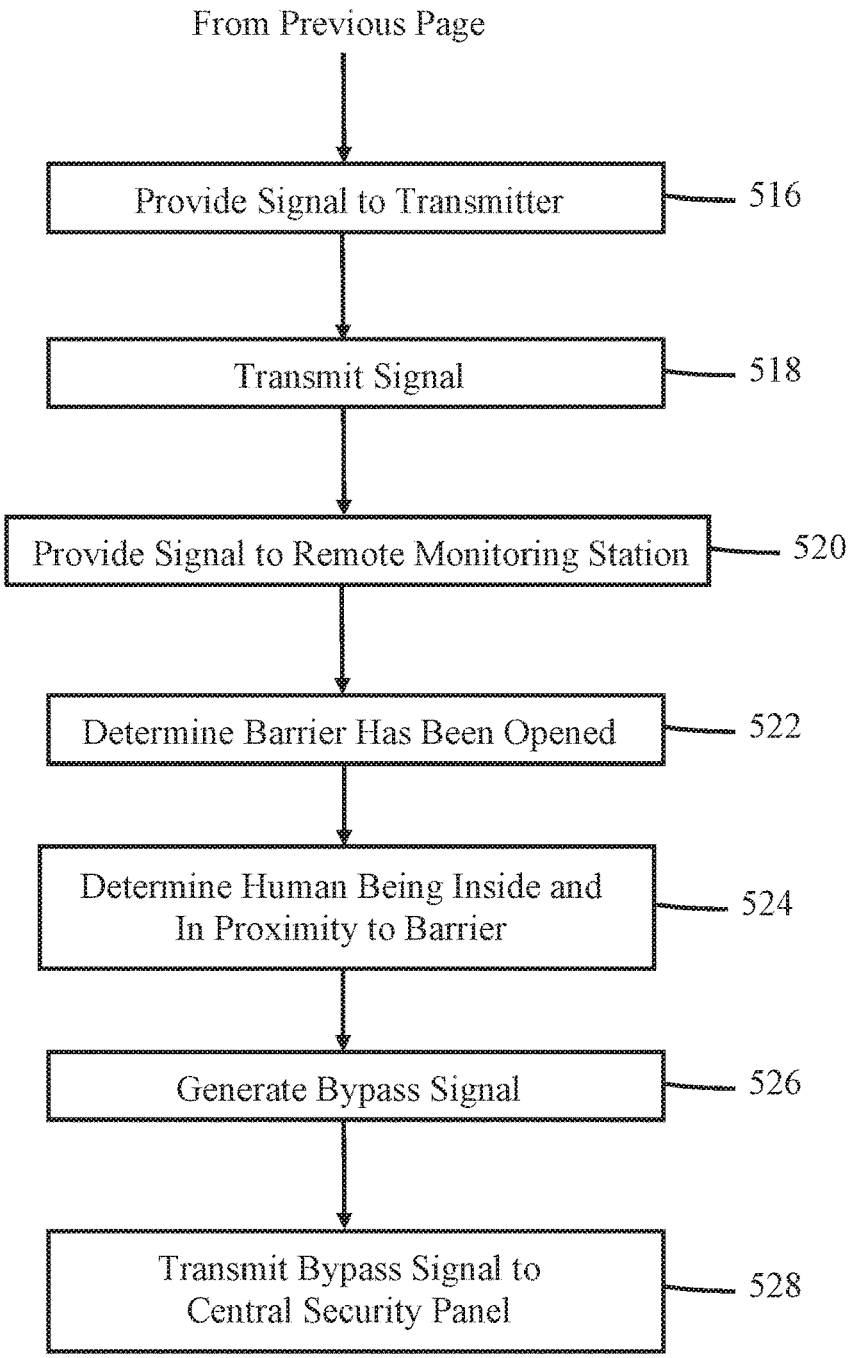

FIG. 5 is a flow diagram illustrating one embodiment of a method performed by a barrier alarm device installed proximate to a door or a window in a premises being monitored, for reducing or preventing the occurrence of false alarms. It should be understood that in some embodiments, not all of the steps shown in FIG. 5 are performed. It should also be understood that the order in which the steps are carried out may be different in other embodiments.

At block 500, processor 300 monitors signals from barrier status detection device 306 and human detection device 304.

At block 502, the barrier (e.g., door or window) is opened by an individual outside the premises.

At block 504, processor 300 determines that the barrier has been opened by detecting a change in a signal from barrier status detection device 306.

At block 506, processor 300 determines that a human being is not inside the premises in proximity to the barrier by evaluating the signals from human detection device 304.

In one embodiment, human detection device 304 periodically evaluates the space inside the premises and in proximity to the barrier to determine whether a human being is present or not. For example, a motion sensor may be energized once every three seconds to determine whether any infrared signal are detected, indicating the presence of a human being. In another embodiment, an ultrasonic transducer may transmit an ultrasonic "ping" once every two seconds to determine whether a return signal is received, indicating the presence of a human being.

In another embodiment, human detection device 304 is kept in a default, "quiescent", de-energized state and energized only when processor 300 determines that the barrier has been opened. The quiescent state refers to a low-power consumption state of operation or a no-power consumption state of operation, e.g., being in an "off" condition. In this way, power savings are achieved by the barrier alert device, as the circuitry comprising human detection device 304 is only energized when the barrier is opened. For example, in an embodiment where human detection device 304 comprises an ultrasonic transducer and an ultrasonic receiver, the ultrasonic transducer and ultrasonic receiver may be powered off until processor 300 determines that the barrier has been opened. In response to determining that the barrier has been opened, processor 300 energizes the ultrasonic transducer and an ultrasonic receiver circuitry and causes the ultrasonic transducer to emit a number of ultrasonic "pings" in order to determine whether a human being is in proximity to the barrier or not. In one embodiment, only a single ping is sent. Processor 300 then determines whether a human being is in proximity of the barrier by determining if a return signal was received by the ultrasonic receiver. If no human being was determined to be in proximity of the barrier, it indicates that the barrier was opened by someone outside the premises, e.g., an unauthorized person. In this case processing continues to block 508. If processor 300 determined that a human being was in proximity of the barrier, then no alarm signal would be transmitted to central security panel, as this is an indication that someone inside the premises opened the barrier, e.g., an authorized person, or a bypass signal is transmitted to central security panel 116.

At block 508, in response to determining that the barrier has been opened and that a human being is not inside the premises in proximity to the barrier, processor 300 generates an alarm signal and provides it to transmitter 308.

At block 510, transmitter 308 transmits the alarm signal to receiver, such as central security panel 116. Alternatively, or in addition, transmitter 308 transmits the alarm signal to gateway 402 connected to a wide area network, such as the Internet, for presentation to remote server 400.

At block 512, central security panel 116 receives the alarm signal from the barrier alarm device and takes at least one action. For example, central security panel 116 may cause a loud siren inside the premises to activate and/or send a remote alarm signal to a remote monitoring station so that the remote monitoring station may summon appropriate authorities to the premises. Remote server 400 may also provide a notification to interested parties that an alarm signal was received.

At block 514, processor 300 determines that the barrier has been placed into a closed position based on signals received from barrier status detection device 306.

At block 516, in response to determining that the barrier has been placed into the closed position, processor 300 provides a signal to transmitter 308 indicating that the barrier is in the closed position.

At block 518, transmitter 308 transmits the signal to either central security panel 116, gateway 402, or both.

At block 520, in response to receiving the signal by central security panel 116 from the barrier alarm device that the barrier is in the closed position, providing a remote alarm signal to a remote monitoring station by central security panel 116 when a future alarm signal is received by central security panel 116 from the barrier alarm device. In other words, the central security panel 116 will no longer ignore alarm signals sent by the barrier alarm device unless another bypass signal is received. Likewise, remote server 400 likewise will no longer ignore alarm signals sent by the barrier alarm device.

At block 522, after the barrier has been closed, processor 300 determines that the barrier has been opened by detecting a change in a signal from barrier status detection device 306.

At block 524, processor 300 determines that a human being is inside the premises in proximity to the barrier by evaluating the signals from human detection device 304.

At block 526, in response to determining that the barrier has been opened and that a human being is inside the premises in proximity to the barrier detection device, processor 300 may refrain from sending an alarm signal to central security panel 116 and gateway 402. Additionally, or alternatively, processor 300 generates a bypass signal and provides the bypass signal to transmitter 308 where it is transmitted to central security device 116 and/or gateway 402. The bypass signal is an instruction to central security panel 116 to ignore future alarm signals generated by the barrier alarm device. The bypass signal may, additionally or alternatively, cause central security panel 116 to disarm the entire security system and to notify one or more persons that the security system has been disarmed, and/or that a barrier has been opened by an authorized person. Similarly, the bypass signal, or a different signal, may be transmitted to gateway 402 to provide an indication to remote server 400 that a barrier has been opened by an authorized person and to ignore future alarm signals generated by the barrier alarm device until the barrier is again placed into the closed position.

At block 528, the bypass signal is transmitted by transmitter 308 to central security panel 116 and/or the same or similar signal is transmitted to gateway 402.

The methods or algorithms described in connection with the embodiments disclosed herein may be embodied directly in hardware or embodied in processor-readable instructions executed by a processor. The processor-readable instructions may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components.

Accordingly, an embodiment of the invention may comprise a computer-readable media embodying code or processor-readable instructions to implement the teachings, methods, processes, algorithms, steps and/or functions disclosed herein.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

We claim:

1. A barrier alarm device, comprising:

a barrier status detection device for detecting whether a barrier monitored by the barrier alarm device has been opened;

a human detection device for determining whether a human being is outside a monitored premises in proximity to the barrier;

a transmitter for transmitting an alarm signal to a receiver;

a memory having processor-executable instructions stored thereon; and a processor coupled to the barrier status detection device, the human detection device, the transmitter, and the memory for executing the processor-executable instructions that cause the barrier alarm device to:

generate, by the processor, the alarm signal when the processor determines that the barrier has been opened based on the barrier status detection device and that a human being is outside the monitored premises in proximity to the barrier.

2. The barrier alarm of claim 1, wherein the processor-executable instructions that cause the processor to generate the alarm signal comprises further instructions that cause the barrier alarm device to:

determine that the barrier has been opened;

determine that a human being is outside the premises and in proximity to the barrier;

in response to determining that the barrier has been opened and that a human being is outside the premises and in proximity to the barrier, generate a bypass signal by the processor; the bypass signal for instructing the receiver to ignore future alarm signals from the barrier alarm device; and transmit the bypass signal to the receiver.

3. The barrier alarm device of claim 1, wherein the processor-executable instructions further comprise instructions that cause the barrier alarm to:

determine that the barrier has been placed into a closed position;

in response to determining that the barrier has been placed into the closed position, transmit a signal to the receiver indicating that the barrier is in the closed position;

in response to receiving the signal by the receiver from the barrier alarm device that the barrier is in the closed position, providing a remote alarm signal to a remote monitoring station by the receiver when a future alarm signal is received by the receiver from the barrier alarm device.

4. The barrier alarm device of claim 1, wherein the human detection device comprises an ultrasonic transducer and an ultrasonic receiver, wherein the processor-executable instructions for determining whether a human being is in proximity to the barrier comprise instructions for the barrier alarm device to:

transmit ultrasonic pings by the ultrasonic transducer at predetermined time periods;

determine that a human being is outside the premises and in proximity to the barrier when an ultrasonic return signal is received by the ultrasonic receiver.

5. The barrier alarm device of claim 1, wherein the human detection device operates in a default quiescent state, wherein the processor-executable instructions for generating an alarm signal comprise instructions for the barrier alarm device to:

in response to determining that the barrier has been opened, energize, by the processor, the human detection device;

generate, by the processor, a signal by the human detection device indicative of whether a human being is in proximity to the barrier or not and provide the signal to the processor;

determine that a human being is outside the premises and in proximity to the barrier, by the processor, using the signal from the human detection device; and return, by the processor, the human detection device back to the quiescent state.

6. The barrier alarm device of claim 5, wherein the human detection device comprises an ultrasonic transducer and an ultrasonic receiver, wherein the processor-executable instructions for detecting whether a human being is outside the premises or not and in proximity to the barrier comprise instructions for causing the barrier alarm device to:

transmit at least one ultrasonic ping by the ultrasonic transducer; and determine that a human being is not outside the premises and in proximity to the barrier if an ultrasonic return signal is not received by the ultrasonic receiver.

7. The barrier alarm device of claim 5, wherein the human detection device comprises a capacitance sensor, wherein the processor-executable instructions for determining whether a human being is inside the monitored premises in proximity to the barrier or not comprise instructions for the barrier alarm device to:

detect a change in capacitance by the capacitance detector;

generate a signal indicative of the capacitance and provide the signal to the processor; and determine that a human being is in proximity to the barrier if the signal from the change in capacitance exceeds a predetermined threshold.

8. A system for monitoring a barrier of a premises, comprising:

a barrier alarm device installed proximate to the barrier, comprising:

a barrier status detection device for detecting whether the barrier monitored by the barrier alarm device has been opened;

a human detection device for determining whether a human being is outside the premises in proximity to the monitored barrier or not;

a transmitter for transmitting status signals to a receiver;

a memory having processor-executable instructions stored thereon; and a processor coupled to the barrier status detection device, the human detection device, the transmitter, and the memory for executing the processor-executable instructions that cause the barrier alarm device to:

determine a barrier status as being open or closed using signals provided by the barrier status detection device;

determine a human being status as being outside the premises in proximity to the monitored barrier or not using signals from the human detection device;

transmit a barrier status signal to the receiver; and transmit a human status signal to the receiver;

the receiver for receiving the barrier status signal and the human status signal and for generating an alarm signal if the receiver determines that the barrier has been opened from the barrier status signal, and that a human being is outside the monitored premises in proximity to the barrier from the human status signal.

9. The system of claim 8, wherein the receiver is further configured to send the alarm signal to a remote monitoring station.

10. The system of claim 8, wherein the human detection device operates in a default quiescent state, wherein the processor-executable instructions for determining whether a human being is outside the monitored premises in proximity to the barrier or not comprise instructions for the barrier alarm device to:

in response to determining that the barrier has been opened, energize the human detection device;

generate a signal by the human detection device indicative of whether a human being is outside the monitored premises in proximity to the barrier or not and provide the signal to the processor;

determine that a human being is not outside the premises in proximity to the barrier by the processor using the signal from the human detection device; and return the human detection device back to the quiescent state.

11. The system of claim 8, wherein the human detection device comprises an ultrasonic transducer and an ultrasonic receiver, wherein the processor-executable instructions for detecting whether a human being is outside the premises and in proximity to the barrier or not comprise instructions for causing the barrier alarm device to:

transmit at least one ultrasonic ping by the ultrasonic transducer; and determine that a human being is not in outside the premises in proximity to the barrier if an ultrasonic return signal is not received by the ultrasonic receiver.

12. A method for a barrier alarm device to reduce occurrences of false alarms, comprising:

determining, by a processor coupled to a barrier status detection device, whether a barrier monitored by the barrier alarm device has been opened;

determining, by the processor coupled to a human detection device, whether a human being is outside a monitored premises in proximity to the barrier; and generating, by the processor, an alarm signal when the processor determines that the barrier has been opened based on the barrier status detection device and that a human being is in proximity to the barrier human detection device.

13. The method of claim 12, further comprising:

determining that the barrier has been opened;

determining that a human being is outside the premises and in proximity to the barrier;

in response to determining that the barrier has been opened and that a human being is outside the premises and in proximity to the barrier, generating a bypass signal by the processor; the bypass signal for instructing the receiver to ignore future alarm signals from the barrier alarm device; and transmitting the bypass signal to a receiver.

14. The method of claim 12, further comprising:

determining that the barrier has been placed into a closed position;

in response to determining that the barrier has been placed into the closed position, transmitting a signal to the receiver indicating that the barrier is in the closed position;

in response to receiving the signal by the receiver from the barrier alarm device that the barrier is in the closed position, providing a remote alarm signal to a remote monitoring station by the receiver when a future alarm signal is received by the receiver from the barrier alarm device.

15. The method of claim 12, wherein the human detection device comprises an ultrasonic transducer and an ultrasonic receiver, wherein determining whether a human being is in proximity to the barrier comprises:

transmitting ultrasonic pings by the ultrasonic transducer at predetermined time periods;

determining that a human being is not outside the premises and in proximity to the barrier when an ultrasonic return signal is not received by the ultrasonic receiver.

16. The method of claim 12, wherein the human detection device operates in a default quiescent state, wherein generating an alarm signal comprises:

in response to determining that the barrier has been opened, energizing the human detection device;

generating a signal by the human detection device indicative of whether a human being is in proximity to the barrier or not and provide the signal to the processor;

determining that a human being is not outside the premises and in proximity to the barrier by the processor using the signal from the human detection device; and returning the human detection device back to the quiescent state.

17. The method of claim 16, wherein the human detection device comprises an ultrasonic transducer and an ultrasonic receiver, wherein detecting whether a human being is outside the premises and in proximity to the barrier or not comprises:

transmitting at least one ultrasonic ping by the ultrasonic transducer; and determining that a human being is not outside the premises and in proximity to the barrier if an ultrasonic return signal is not received by the ultrasonic receiver.

18. The barrier alarm device of claim 16, wherein the human detection device comprises a capacitance sensor, wherein determining whether a human being is outside the monitored premises in proximity to the barrier or not comprises:

detecting a change in capacitance by the capacitance detector;

generating a signal indicative of the capacitance and provide the signal to the processor; and determining that a human being is in proximity to the barrier if the signal from the change in capacitance exceeds a predetermined threshold.

19. A system for monitoring a barrier of a premises, comprising:

a barrier alarm device installed proximate to the barrier, comprising:

a barrier status detection device for detecting whether the barrier monitored by the barrier alarm device has been opened;

a human detection device for determining whether a human being is outside the premises in proximity to the monitored barrier or not;

a transmitter for transmitting status signals to a receiver;

a memory having processor-executable instructions stored thereon; and a processor coupled to the barrier status detection device, the human detection device, the transmitter, and the memory for executing the processor-executable instructions that cause the barrier alarm device to:

determine a barrier status as being open or closed using signals provided by the barrier status detection device;

determine a human being status as being outside the premises in proximity to the monitored barrier or not using signals from the human detection device;

transmit a barrier status signal to the receiver; and transmit a human status signal to the receiver;

the receiver for receiving the barrier status signal and the human status signal and for forwarding the barrier status signal and the human status signal to a remote server, the remote server for generating an alarm signal if the remote server determines that the barrier has been opened from the barrier status signal, and a human being is outside the premises in proximity to the barrier from the human status signal.

20. The system of claim 19, wherein the human detection device operates in a default quiescent state, wherein the processor-executable instructions for determining whether a human being is outside the monitored premises in proximity to the barrier or not comprise instructions for the barrier alarm device to:

in response to determining that the barrier has been opened, energize the human detection device;

generate a signal by the human detection device indicative of whether a human being is outside the premises and in proximity to the barrier or not and provide the signal to the processor;

determine that a human being is outside the premises and in proximity to the barrier by the processor using the signal from the human detection device; and return the human detection device back to the quiescent state.

* * * * *